US006440917B1

(12) United States Patent
Church et al.

(10) Patent No.: US 6,440,917 B1
(45) Date of Patent: Aug. 27, 2002

(54) CLEANING METAL SALTS OF INTERMEDIATE LENGTH CARBOXYLIC ACIDS FROM SURFACES

(75) Inventors: Richard J. Church, Berkley; Kenneth J. Hacias, Sterling Heights, both of MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/530,300

(22) PCT Filed: Nov. 3, 1998

(86) PCT No.: PCT/US98/22650

§ 371 (c)(1),
(2), (4) Date: Apr. 27, 2000

(87) PCT Pub. No.: WO99/24534

PCT Pub. Date: May 20, 1999

Related U.S. Application Data

(60) Provisional application No. 60/064,464, filed on Nov. 6, 1997.

(51) Int. Cl.[7] ..... C11D 3/04; C11D 3/20; C11D 3/30

(52) U.S. Cl. ..... 510/272; 510/245; 510/254; 510/270; 510/508

(58) Field of Search ..... 510/248, 254, 510/269, 272, 245, 270, 508; 134/3, 40, 41

(56) References Cited

U.S. PATENT DOCUMENTS 5,250,230 A * 10/1993 Steele et al. ..... 252/544
5,433,885 A * 7/1995 Winston et al. ..... 252/174.24
5,520,841 A * 5/1996 Block et al. ..... 252/174.23

* cited by examiner

*Primary Examiner*—Gregory Del Cotto
(74) *Attorney, Agent, or Firm*—Stephen D. Harper; William G. Conger

(57) ABSTRACT

Problems of extensive foaming and/or of sticky deposits on process equipment that often arise when metal soaps from metal articles that have been given a metal soap containing surface to aid in drawing are removed with aqueous alkaline clearners can be avoided by including in the cleaners used anions such as calcium and magnesium that are capable of precipitating the anions of the metal soaps. The cleaners advantageously also contain chelants, a mixture of nonionic and anionic surfactants, and phosphorus containing anions. Anions from the metal soaps are eventually precipitated from the cleaners used as non-sticky sludge that can be easily separated from the cleaners.

10 Claims, No Drawings

CLEANING METAL SALTS OF INTERMEDIATE LENGTH CARBOXYLIC ACIDS FROM SURFACES

CROSS-REFERENCE TO RELATED APPLICATIONS

This application claims the benefit of U.S. Provisional Application No. 60/064,464, filed Nov. 6, 1997. This application also is a U.S. national phase PCT application Ser. No. PCT/US98/22650, filed Nov. 3, 1998.

BACKGROUND OF THE INVENTION

This invention relates to management of a cleaning process that removes metal salts of intermediate length carboxylic acids, i.e., fatty acids with from 10 to 22 carbon atoms per molecule, from surfaces where such salts are present over an underlying water insoluble substrate, particularly a metal substrate. (The remainder of this description will concentrate on metal substrates, but it is to be understood that it applies, mutatis mutandis, to other types of substrates that are not substantially damaged by contact with or dissolved in water.) Between the exposed surface of metal intermediate length carboxylate salt(s) and the substrate surface, there may or may not be other layers such as phosphate conversion coatings, anodized coatings, or complex oxide layers such as those that can be formed with a commercially available product named BONDERITE® 770X from the Henkel Surface Technologies Div. of Henkel Corp., Madison Heights, Mich.

Metal salts, particularly water-insoluble ones, of intermediate length carboxylic acids are widely used as lubricants for cold drawing of steel and other metals, usually over a phosphate or other conversion coating that is believed to act as a "carries" for the lubricative metal intermediate length carboxylate salt(s). After cold drawing has been completed, in most instances the metal intermediate length carboxylate salt(s) and any underlying conversion coating need to be removed before further processing of the metal article that has been cold drawn.

Such removal/cleaning has been conventionally accomplished with strongly alkaline cleaners, which preferably also contain sequestering agents for the metal cations in any underlying conversion coating, when such a coating is present, and surfactants to aid in wetting of the surface and dispersing and removing soils. However, when substantial amounts of metal intermediate length carboxylate salt(s) have been dissolved in such a cleaner, it becomes strongly prone to foaming, which causes practical difficulties in processing. Up to now, surfactant anti-foam agents have been primarily used to control such foaming, but their success leaves much to be desired in many practical operations: Even if foaming is effectively prevented, as is by no means always accomplished, solid, adherent deposits on various parts of the process equipment tend to accumulate with continued use of a fixed volume of cleaner. Spots or patches of adhering deposit also may be formed on the otherwise cleaned surfaces. Accordingly, a major object of this invention is to provide a method of avoiding impractical degrees of foaming and of adherent deposits on process equipment, or on the otherwise cleaned articles, during cleaning of metal intermediate length carboxylate salt(s) from underlying metal substrates. An alternative object is to achieve results that are more economical, more consistent in cleaning quality, or both, when cleaning metal salts of intermediate length carboxylic acids from metal substrates. Other alternative or concurrent objects will be apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not necessarily preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may by used for any chemical species defined by all of the types and numbers of atoms present in it, irrespective of whether the species is ionic, neutral, unstable, hypothetical, or in fact a stable neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.

BRIEF SUMMARY OF THE INVENTION

It has been found that at least one, and in favorable instances more than one, object of the invention as stated above can be achieved by using a particular type of aqueous liquid alkaline cleaning composition that comprises, preferably consists essentially of, or more preferably consists of, water and:

(A) a concentration of dissolved potassium cations; and (B) a concentration of a component of dissolved metal cations selected from the group consisting of cations with at least one intermediate length carboxylate salt that has a solubility in water at 25° C. that is not greater than 0.15 grams per liter (hereinafter usually abbreviated as "g/l"); and, optionally, one or more of the following components:

(C) a component of dissolved chelating agent molecules;

(D) a component of dissolved surfactant molecules that are not also chelating agents;

(E) a component selected from phosphorus-containing anions that are not part of any of immediately previously recited components (A) through (D); and (F) a component of inhibitors of at least one of corrosion, staining, or other surface blemishing of metal surfaces, said inhibitors not being part of any of immediately previously recited components (A) through (E), said aqueous liquid alkaline cleaning composition, if it contains any dissolved sodium cations, having a molar ratio of the concentration of said sodium cations to potassium cations that is not more than 0.17:1.0. A composition according to the invention may be ready for immediate use in cleaning, in which instance it may be designated hereinafter as a "working composition", or it may be a concentrate composition which is suitable for mixture with water and, optionally, one or more other concentrate compositions to form a working composition. Of course, some compositions according to the invention are suitable for both of these methods of use.

The relatively inexpensively available cations suitable for component (B) of a composition according to the invention as described above also have hydroxides with relatively low solubility in water and therefore can not normally be provided as solutes in substantial concentration in strongly alkaline aqueous solutions. Surprisingly, however, it has been found that if all or most of the alkali metal cations present in the composition are potassium ions instead of the more commonly used sodium ions, a sufficient concentration of solute cations of metals that form no more than sparingly soluble salts with intermediate length carboxylate anions can be maintained in a highly alkaline aqueous solution and still retain their ability to form solid salts with intermediate length carboxylate salt anions that are dissolved at least temporarily into the aqueous liquid alkaline cleaning compositions containing these precipitating type cations. As a result, eventually the used cleaning compositions develop dispersed, floating, and/or settled solid particles of intermediate length carboxylate salt(s) in a form that does not readily adhere to the article(s) being cleaned or to process equipment in which cleaning with such an aqueous liquid alkaline cleaning composition according to the invention is being performed. Instead these solid particles can be removed when convenient, by any of the many means known in the art for separating solids and liquids. Furthermore, when the maximum concentration of dissolved intermediate length carboxylate anions is limited in this way, foaming tendencies of the aqueous liquid alkaline cleaning compositions are greatly reduced, so that often no anti-foam agent at all is necessary, and if such an agent is used, its concentration can be kept substantially lower than is necessary to prevent unacceptable foaming in otherwise identical aqueous liquid alkaline cleaning compositions with higher concentrations of dissolved intermediate length carboxylate anions.

In addition, if desired, additional precipitating cations of the same type of materials as are used for component (B) in a composition according to this invention as described above can be added to the used aqueous liquid alkaline cleaning compositions according to the invention, thereby precipitating more of the dissolved intermediate length carboxylate anions and regenerating the used aqueous liquid alkaline cleaning compositions for reuse as if they were freshly prepared compositions.

Accordingly, for cleaning a solid article having a solid surface that includes at least one metal intermediate length carboxylate salt as a soil to be removed during the cleaning, said solid surface also having a metal substrate underlying it, optionally under intermediate layers of other materials, a process according to the invention comprises, preferably consists essentially of, or more preferably consists of, the following process operations:

(I) providing a volume of an aqueous liquid alkaline cleaning composition according to the invention as described above that (i) is capable of dissolving the metal intermediate length carboxylate salt present on the surface of the article to be cleaned and (ii) contains as part of its component (B) metal cations that are capable of forming salts with all of the anions of all of the intermediate length carboxylate salt(s) present on the surface of the article to be cleaned, said salts having a solubility in water at 25° C. that is not greater than 0.15 g/l; and (II) contacting the aqueous liquid alkaline cleaning composition that is provided in operation (I) with the surface of the article to be cleaned that includes said metal intermediate length carboxylate salt for a sufficient time that at least a part of said metal intermediate length carboxylate salt is transferred from said solid surface to solution or dispersion in said aqueous liquid alkaline cleaning composition, thereby converting it to a used aqueous liquid alkaline cleaning composition and converting said solid article to be cleaned to a cleaned and at least initially wet solid article; and, optionally, one or more of the following operations:

(III') rinsing from the surface of the cleaned article provided at the end of operation (II) any residue of said aqueous liquid alkaline cleaning composition that remains in contact with the cleaned article and drying the surface to provide a cleaned dry article;

(III") continuing operation (II), with a single article or with one or more additional articles, until at least some of the metal intermediate length carboxylate salt transferred from said article(s) to said aqueous liquid alkaline cleaning composition is present therein as a dispersion of a solid salt with cations derived from component (B) of the aqueous liquid alkaline cleaning composition provided in operation (I), and thereafter separating at least part of said solid salt with cations derived from component (B) of the aqueous liquid alkaline cleaning composition provided in operation (I) from the liquid phase in which it is dispersed in the used aqueous liquid alkaline cleaning composition, thereby converting it to partially regenerated used aqueous liquid alkaline cleaning composition;

(III'") adding, to at least part of at least one of (i) said used aqueous liquid alkaline cleaning composition generated by the end of operation (II) and (ii) said partially regenerated used aqueous liquid alkaline cleaning composition generated by the end of operation (III"), precipitating cations that cause, within a time of not more than one hour after said adding of precipitating cations, a solid phase comprising at least part of said precipitating cations and at least part of the metal intermediate length carboxylate anions present in said part of said used, said partially regenerated used, or both said used and said partially regenerated used aqueous liquid alkaline cleaning composition to separate as a solid phase from said used, said partially regenerated used, or both said used and said partially regenerated used aqueous liquid alkaline cleaning composition, thereby converting the used, partially regenerated used, or both used and partially regenerated used aqueous liquid alkaline cleaning composition into a fully regenerated aqueous liquid alkaline cleaning composition; and (IV) providing the regenerated aqueous liquid alkaline cleaning composition that is generated by the end of operation (III'") as the aqueous liquid alkaline cleaning composition for a repetition of operations (I) and (II) as described above with another part of the same surface of said article to be cleaned or with at least part of the surface of a distinct second article, said distinct second article having the characteristics as recited above for the solid article to be cleaned in operation (I).

Other operations that are conventional in themselves, such as prior cold working, application of the metal intermediate length carboxylate salt(s) lubricant to the substrate article prior to cold working, rinses, recovery and recycling of the metal intermediate length carboxylate anions from precipitate, and the like may be incorporated into a process according to this invention that includes the above minimum operations.

DETAILED DESCRIPTION OF THE INVENTION

An aqueous liquid alkaline cleaning composition according to this invention does not need to contain any sodium cations, but if it does, the ratio of the molar amounts of dissolved sodium ions and dissolved potassium ions present in any sample of the composition, at least if it is a concentrate composition, preferably is not more than, with increasing preference in the order given, 0.165:1.00, 0.145:1.00, 0.130:1.00, 0.115:1.00, 0.100:1.00, 0.090:1.00, 0.080:1.00, or 0.075:1.00, in order to maximize stability of at least a concentrate composition according to the invention. If the molar sodium to potassium ratio is higher than 0.165:1.00, a concentrate composition according to the invention will usually develop turbidity on storage for a few days and sometimes can not be prepared at all as a transparent solution, as is preferred. The storage stability is not adversely affected by still lower sodium to potassium ratios than those specified above, but if this ratio is very low, the foaming tendency of a working composition according to the invention is at least slightly increased. Therefore, ordinarily the presence of some solute sodium cations in at least a working composition according to the invention is preferred, and if the ratio of sodium to potassium is not too high, such sodium cations do no harm in a concentrate composition according to the invention. More particularly, independently of the above recited preferable maxima for the sodium to potassium molar ratio, this ratio in at least a working composition according to the invention preferably is at least, with increasing preference in the order given, 0.005:1.00, 0.010:1.00, 0.020:1.00, 0.030:1.00, 0.040:1.00, 0.050:1.00, 0.055:1.00, 0.060:1.00, 0.065:1.00, 0.070:1.00, or 0.073:1.00. In calculating the ratios considered in this paragraph, the concentrations of dissolved potassium and sodium ions are to be assumed to include all of such ions contained in any salt or hydroxide of these metals dissolved in the composition, irrespective of the actual extent(s) of ionization of such dissolved salt or hydroxide. Potassium ions are preferably provided at least partially from potassium hydroxide, in order to achieve the preferred high alkalinity of the compositions. Sodium ions may be provided also as the hydroxide, but any sodium provided from other sources that are soluble in water must be taken into account in calculating the above ratios.

A concentrate composition according to the invention preferably contains potassium hydroxide in a concentration, measured as a percent of the total concentrate, that is at least, with increasing preference in the order given, 3.0, 4.0, 5.0, 6.0, 7.0, 8.0, 9.0, 10.0, 11.0, 11.5, 12.0, 12.5, or 13.0%. These minimum preferences are primarily economically motivated, specifically to avoid transport costs, from the point of manufacture of the concentrate to the point of its use, for water that can usually conveniently and less expensively be added at the point of use. In order to avoid precipitation or turbidity development during storage, however, the concentration even in a concentrate can not be increased without limit. For this reason, independently of the preferences for a minimum concentration already stated above, a concentrate composition according to this invention preferably contains not more than 27.5, 27.0, 26.5, 26.0, 25.5, 25.0, 24.5, or 24.1% of potassium hydroxide. The corresponding stoichiometric concentrations of potassium cations are independently preferred in a concentrate composition according to the invention, even if not all or nearly all of the potassium cations are supplied by potassium hydroxide.

Any of the large number of cations that have sufficiently small solubility product constants for their intermediate length carboxylate salt(s) may be used for necessary component (B) of a composition according to the invention. Primarily for reasons of economy and lack of any known toxicity or environmental pollution potential, calcium and magnesium cations are usually preferred, with calcium somewhat more preferred, and their chloride and nitrate salts are preferred sources for these "precipitating" cations of component (B).

In a concentrate composition according to the invention, cations of component (B) preferably are present in a concentration, measured in moles of these cations per kilogram of total composition (a unit hereinafter usually abbreviated as "M/kg"), that is at least, with increasing preference in the order given, 0.030, 0.060, 0.090, 0.11, 0.13, 0.15, 0.17, 0.19, 0.21, 0.23, or 0.25 M/kg and independently preferably is not more than, with increasing preference in the order given, 2.0, 1.5, 1.0, 0.75, 0.65, 0.60, 0.55, 0.45, 0.40, 0.35, 0.30, or 0.26 M/kg. If the concentration of precipitating cation component (B) is too low, it will not accomplish its intended purpose of causing dissolved intermediate length carboxylate anions to precipitate in an innocuous, readily separable form as they begin to exceed the solubility limit of their least soluble salt in equilibrium with the other constituents of a used cleaning composition according to the invention, rather than as sticky deposits on solid parts of the process equipment or otherwise clean articles that are being cleaned in a process according to the invention. On the other hand, if the concentration of these precipitating cations is too high, the intended aqueous liquid alkaline cleaning composition will be incapable of cleaning effectively, because the residues of intermediate length carboxylate salt(s) to be removed will not be sufficiently soluble to ever dissolve or be dispersed in the cleaning solution initially. At intermediately high concentrations, the technical effectiveness of the cleaning solutions may not be adversely affected, but there will be a higher cost with no offsetting benefit.

Independently of the actual concentrations of precipitating cations and potassium cations, the molar ratio between them in a composition according to the invention preferably is at least, with increasing preference in the order given, 0.005:1.00, 0.010:1.00, 0.020:1.00, 0.030:1.00, 0.040:1.00, 0.050:1.00, 0.055:1.00, 0.060:1.00, 0.065:1.00, 0.068:1.00, or 0.071:1.00 and independently preferably is not more than, with increasing preference in the order given, 0.145:1.00, 0.130:1.00, 0.115:1.00, 0.100:1.00, 0.090:1.00, 0.085:1.00, 0.080:1.00, or 0.075:1.00.

At least when an underlying conversion coating is to be removed along with metal intermediate length carboxylate salt(s) in a process according to this invention, the aqueous liquid alkaline cleaning composition used preferably also contains a chelating agent for multivalent metal cations (i.e., metal cations with at least two positive electric charges). Any chelating agent used is preferably selected from the group consisting of molecules each of which contains at least two nucleophilic moieties selected from the group consisting of carboxyl, carboxylate, non-carboxyl hydroxyl, amino, thio, phosphonic acid, phosphonate, phosphinic acid, and phosphinate moieties, with these at least two moieties being bonded into the molecule in positions such that a five- or six-membered ring of atoms can be formed by atoms in the molecule and a multivalent metal atom that is coordinatively covalently bonded to a nucleophilic atom (i.e., oxygen, nitrogen, sulfur, or phosphinic phosphorus) in each of said nucleophilic moieties in the molecule.

More preferably, any chelating agent is selected from the group consisting of gluconic, citric, and malic acids, polymers of acrylic and maleic acids, and water soluble salts of all of these acids and polymers of acids, the salts being most preferably used in view of the independent preference for strongly alkaline aqueous liquid alkaline cleaning compositions, or still more preferably from gluconic acid and its salts.

When highly preferred sodium gluconate is present in a concentrate aqueous liquid alkaline cleaning composition according to this invention, the concentration of sodium gluconate preferably is at least, with increasing preference in the order given, 0.7, 1.5, 2.0, 3.0, 4.0, 4.5, 5.0, 5.2, 5.4, or 5.6% of the total composition and independently preferably, primarily for reasons of economy, is not more than, with increasing preference in the order given, 25, 20, 16, 12, 10, 9, 7.0, 6.4, 6.0, or 5.8% of the total composition. Further and independently, when sodium gluconate is present, the ratio of its concentration to that of hydroxide ions in a composition according to the invention preferably is at least, with increasing preference in the order given, 0.10:1.00, 0.20:1.00, 0.30:1.00, 0.40:1.00, 0.50:1.000, 0.60:1.00, 0.70:1.00, 0.80:1.00, 0.85:1.00, 0.90:1.00, or 0.93:1.00 and independently preferably is not more than, with increasing preference in the order given, 10:1.00, 8:1.00, 6:1.00, 4.0:1.00, 2.0:1.00, 1.80:1.00, 1.60:1.00, 1.40:1.00, 1.30:1.00, 1.20:1.00, 1.00:1.00, or 0.95:1.00.

If some other chelating agent that consists of molecules each of which contains at least two moieties selected from the group consisting of carboxyl, carboxylate, non-carboxyl hydroxyl, amino, thio, phosphonic acid, phosphonate, phosphinic acid, and phosphinate moieties is used, either alone or in combination with sodium gluconate, these numerical preferences should be adjusted so as to provide the same numbers of molecules of substances each molecule of which contains at least two moieties selected from the group consisting of carboxyl, carboxylate, non-carboxyl hydroxyl, amino, thio, phosphonic acid, phosphonate, phosphinic acid, and phosphinate moieties as are provided by the numbers given above for sodium gluconate as the only such chelating agent, except that if polymeric chelating agents containing carbon chain "backbones" with pendant moieties selected from the group consisting of carboxyl, carboxylate, non-carboxyl hydroxyl, amino, thio, phosphonic acid, phosphonate, phosphinic acid, and phosphinate moieties are utilized, each moiety of such a polymer molecule that contains at least two of said pendant moieties that are not shared with a distinct moiety of the same type in the same polymer molecule is to be considered as a separate molecule for purposes of this calculation.

Ordinarily it is preferable for an aqueous liquid alkaline cleaning composition according to this invention to contain surfactant materials in addition to any chelating agent that it may contain. Nonionic and anionic surfactants are preferred over cationic ones, with a combination of nonionic surfactant and anionic surfactant being more preferred than either alone. Preferably at least, with increasing preference in the order given, 5, 10, 15, 18, 20, 22, 24, 26, or 28% of the total surfactant is nonionic. Independently, in a concentrate composition according to the invention, the total surfactant has a concentration of at least, with increasing preference in the order given, 0.5, 1.0, 1.5, 2.0, 2.3, 2.6, 2.9, 3.1, 3.3, 3.5, or 3.7% and independently, primarily for reasons of economy, preferably has a concentration that is not more than, with increasing preference in the order given, 15, 10, 8.0, 7.5, 7.0, 6.5, 6.0, 5.5, 5.0, 4.5, or 4.0%.

In one highly preferred specific embodiment of the invention, the surfactant component includes mono-amine salts of partial esters of aromatic-moiety-containing partial esters of phosphoric acid as its anionic surfactant. The desired anionic and nonionic surfactant mixture is conveniently provided by a commercial product, KRITCHEM™ 1248M surfactant obtained from Kritchem, Inc. of Tucson, Ariz. and reported by its supplier to contain a total of 82% of its active ingredients, which are monoethanol amine, aromatic phosphate ester(s) surfactant with a CAS Registry Number of 39-464-70-5, and nonionic surfactant with a CAS Registry Number of 68-131-40-8. These types of surfactants are also available separately from other sources and may effectively be used alone or in mixtures with each other and, optionally, an amine such as monoethanol amine to neutralize any anionic surfactant present.

A second distinct particularly preferred embodiment of the invention uses as the nonionic part of its surfactant component an ethoxylated alkyl phenol such as TRITON™ X-100 surfactant, reported by its supplier to be ethoxylated octyl phenol with a hydrophile-lipophile balance value of 13.5, and as the nonionic part of its surfactant component an ethoxylated partial ester such as TRITON™ DF-20 surfactant, which is reported by its supplier to be a modified ethoxylated acid form anionic surfactant.

If a phosphorus-containing anion component has not been used as any of components (A) through (D) as described above, phosphorus-containing anions are preferably used as separate optional component (E). (For example, when the KRITCHEM™ surfactant described above is used in preferred amounts, it contains sufficient phosphorus-containing anions that no separate component (E) is advantageous, but the mixture of TRITON™ surfactants described as part of an alternative particularly preferred embodiment are advantageously supplemented with optional component (E) as described above.) Any inorganic phosphate or phosphite salt and/or any salt of a partial ester of phosphoric or phosphorous acid may be used to provide this component. At least for economy, however, readily available and relatively inexpensive salts of at least one of metaphosphoric acid, orthophosphoric acid, and the condensed phosphoric acids are preferred, with dihydrogen phosphates particularly preferred. When component (E) is used in a concentrate composition according to the invention, the mass of phosphorus atoms that are part of anions in component (E) preferably constitutes an amount of the total concentrate that is at least, with increasing preference in the order given, 0.02, 0.04, 0.06, 0.08, 0.10, 0.12, 0.14, 0.16, 0.18, 0.20, or 0.22% and independently preferably is not more than, with increasing preference in the order given, 5, 3, 2.0, 1.0, 0.80, 0.70, 0.60, 0.50, 0.45, 0.40, 0.35, 0.30, or 0.25%. If the total concentration of phosphorus in dissolved anions in a concentrate composition according to the invention is lower than 0.02, storage stability has been observed to be reduced, while if the concentration of phosphorus in dissolved anions in a concentrate composition according to the invention is higher than 5%, too much foaming has been observed in the working compositions made from such a concentrate. The mechanism by which phosphorus-containing anions might so influence the storage stability or foaming tendency of compositions according to this invention is not known.

An aqueous liquid alkaline cleaning composition used according to the invention may of course optionally contain other constituents. For example, if post-rusting of the cleaned article is observed, a corrosion inhibitor distinct from any of the other constituents considered above may be advantageous as a constituent of the cleaner. A very wide variety of substances suitable for this purpose are known to those skilled in the art, and can be added to any rinse water used in optional operation (III') instead of or in addition to the aqueous liquid alkaline cleaning composition itself.

A single package is preferred for a concentrate composition according to the invention. Therefore, all of the preferred component ratios stated above for concentrate compositions apply without change to working compositions according to the invention.

In a working composition according to the invention, the preferred concentrations of the necessary and optional components usually are expressed in terms of the total volume of working composition rather than the total mass as with concentrate compositions, because the volume of working composition can often be measured more easily than the mass, especially in large commercial plants. Preferred working compositions contain 3 to 10% by volume of preferred concentrate compositions as described above.

During its use in cleaning in operation (II) as described above of a process according to this invention, the temperature of an aqueous liquid alkaline cleaning composition is preferably maintained at a temperature that is at least, with increasing preference in the order given, 30, 40, 50, 60, 65, 70, 75, 80, or 84° C. and independently preferably, primarily for reasons of economy, is not more than, with increasing preference in the order given, 99, 97, 95, 93, 91, 89, or 87° C. If rinsing operation (III') is used as is normally preferred, the rinse liquid temperature during rinsing preferably should be high enough that the cleaned and rinsed article will spontaneously dry in the normal ambient natural atmosphere within a time of not more than, with increasing preference in the order given, 10, 8, 6, 4, 2.0, 1.0, 0.8, 0.6, or 0.4 minutes (hereinafter usually abbreviated as "min"). A rinsing temperature that is at least, with increasing preference in the order given, 45, 50, 52, 54, or 56° C. will generally be satisfactory to accomplish this purpose.

The time of contact between the substrate article to be cleaned and the aqueous liquid alkaline cleaning composition during cleaning operation (II) as described above of a process according to the invention should be sufficient to accomplish the degree of cleaning desired. When substantially complete removal of the solid metal intermediate length carboxylate salt(s) and of a conversion coating of customary composition (usually zinc phosphate) and thickness (usually corresponding to at least several grams of conversion coating per square meter of substrate treated) from the substrate is desired, as is most usual in the practice of this invention, the time of contact during cleaning preferably is at least, with increasing preference in the order given, 1.0, 1.5, 2.0, 2.5, 3.0, 3.5, or 4.0 min and independently, primarily for reasons of economy, preferably is not more than 20, 15, 12, 10, 8, 6, or 4.5 min.

Complete regeneration of used aqueous liquid alkaline cleaning compositions, as optionally performed in operation (III'") of a process according to the invention as described above, is preferably accomplished as set forth below.

Intermediate length carboxylate anion(s) are precipitated by addition of appropriate cations (for example, Ca, Mg, or Ba) that will cause, within a time of not more than one hour after said adding of precipitating cations, a salt comprising at least part of said precipitating cations and at least part of the metal intermediate length carboxylate anions present in said used aqueous liquid alkaline cleaning composition to separate as a solid phase from said used aqueous liquid alkaline cleaning composition, thereby converting the used aqueous liquid alkaline cleaning composition into a fully regenerated aqueous liquid alkaline cleaning composition The precipitated salts can be removed from the used aqueous liquid alkaline cleaning composition by filtration, by allowing the precipitated salts to settle as a sludge and then draining the sludge from the bottom of a holding tank, by skimming any floating precipitate off a holding tank for the circulating cleaning composition, and/or by any other suitable method for separating solids from liquids, many of which are known to those skilled in the art. After the intermediate length carboxylate anions have been thus removed from the cleaning composition, the composition can be re-used indefinitely, without impractical foaming problems, as long as any ingredients consumed during use are replenished and any subsequent accumulations of intermediate length carboxylate anions in the composition are removed when needed by repetition of the removal steps described above. A clean surface suitable for immediate further processing of the cold-drawn metal substrate can normally be achieved, after the cleaning as described above, by rinsing any residue of cleaning solution from the cleaned substrates in sufficiently hot water to cause the substrate to flash dry by evaporation after rinsing.

Before or as part of operation (III'") as described above, the part of the used aqueous liquid alkaline cleaning composition to be treated normally is preferably transferred to a location where none of the transferred part of the used aqueous liquid alkaline cleaning composition is in contact with said solid surface to be cleaned, in order to avoid any danger of precipitating metal intermediate length carboxylate salt(s) onto the otherwise cleaned surface. Such transfer is readily accomplished by a conventional circulation loop as used for spray cleaning, in which used cleaning composition runs more or less continuously off of the substrate(s) being cleaned into a collector from which it is pumped back eventually to the spray nozzles. A holding tank is often already present in such a circulation loop, or can readily be introduced if not already present, so that the addition of precipitating cations can be accomplished by additions to the holding tank. Many alternative mechanical arrangements for accomplishing the same purpose will be apparent to those skilled in the art.

Experience may show in some instances that the precipitate formed does not tend to stick to cleaned metal surfaces, and in such an instance, precipitating cations can effectively be added if desired to a common container for the substrate to be cleaned and the part of the aqueous liquid alkaline cleaning composition being treated.

Rather small concentrations of intermediate length carboxylate anions are capable of greatly enhancing foaming, particularly when an aqueous liquid alkaline cleaning composition is sprayed onto the substrate article to be cleaned, as is usually preferred, and/or when the aqueous liquid alkaline cleaning composition is continuously circulated through a holding tank into or out of which a substantial flow rate is maintained, causing the surface at the top of the liquid layer in the holding tank to be continuously mechanically disturbed and thereby to incorporate air that can sustain foam bubbles. It is therefore preferred in a process according to the invention that operation (II) as defined above be discontinued for any particular volume of aqueous liquid alkaline cleaning composition as soon as the concentration of intermediate length carboxylate anions in the specified volume of aqueous liquid alkaline cleaning composition has come to exceed, with increasing preference in the order given, 0.05, 0.10, 0.15, 0.20, 0.25, 0.30, 0.35, 0.40, 0.45, 0.50, 0.55, 0.60, 0.65, 0.70, or 0.75 g/l. Analogously but independently, in operation (III) of a process according to the invention as described above, a sufficient amount of precipitating cations to cause the concentration of intermediate length carboxylate anions in the regenerated aqueous liquid alkaline cleaning composition at the end of operation (III) not to exceed, with increasing preference in the order given, 0.50, 0.45, 0.40, 0.35, 0.30, 0.25, 0.20, 0.15, 0.10, 0.08, 0.06, 0.04, 0.02, 0.007, 0.004, or 0.001 g/l of intermediate length carboxylate anions is preferred.

Any of the large number of cations that have sufficiently small solubility product constants for their intermediate length carboxylate salt(s) to reduce the concentration of intermediate length carboxylate anions, in a regenerated used aqueous liquid alkaline cleaning composition at the end of process operation (III'") as described above of a process according to the invention, below the upper limit desired for this constituent, combined with a sufficiently large solubility in water of some other salt of the precipitating cations to form an appropriate precipitating solution, may be used in a process according to the invention. Primarily for reasons of economy, calcium and magnesium precipitating cations are usually preferred, and their chloride and nitrate salts are preferred sources for these ions in a solution of the precipitating cations in water. (In principle, solid salts of the precipitating cations can also be added directly to the used aqueous liquid alkaline cleaning composition in operation (III'") of a process according to the invention as defined above. In practice, however, such a method is much less preferred, because the intermediate length carboxylate salt (s) of the most used precipitating cations have such low solubility in water that the surface of even a fine particle of a water soluble salt of a precipitating cation can become coated with a deposit of precipitated metal intermediate length carboxylate salt(s) that prevents the interior of the particle from dissolving and contributing its precipitating cations content to the precipitation process. Therefore, adding the precipitating cations in the form of a solution in water is almost always preferred in operation (III'").

Surprisingly, in view of the low solubility of most divalent and trivalent metal intermediate mediate length carboxylate salts in water, considerably more than a stoichiometric amount of precipitating cations is required to obtain the maximum amount of foam abatement in a process according to this invention. More specifically, even though divalent precipitating cations form salts with twice their molar amounts of intermediate length carboxylate anions, if it is desired to reduce foaming as much as possible, by the end of operation (III) as described above in a process according to this invention, the molar ratio between {the amount of divalent precipitating cations added to the amount it of used aqueous liquid alkaline cleaning composition being regenerated} and {the amount of intermediate length carboxylate anions present at the beginning of operation (III) as described above in the used aqueous liquid alkaline cleaning composition being regenerated} preferably is at least, with increasing preference in the order given, 1.00:1.00, 2.0:1.00, 3.0:1.00, 4.0:1.00, 5.0:1.00, 6.0:1.00, 6.5:1.00, 7.0:1.00, 7.5:1.00, 8.0:1.00, 8.5:1.00, 9.0:1.00, 9.5:1.00, or 10.0:1.00. Independently and primarily for reasons of economy, this ratio preferably is not greater than, with increasing preference in the order given, 40:1.00, 30:1.00, 25:1.00, 20:1.00, or 15:1.00 and may of course be even less if foam abatement adequate for the particular use is thereby achieved.

During formation of a precipitate in operation (III'") as described above of a process according to this invention, the temperature of an aqueous liquid alkaline cleaning composition is preferably maintained at a temperature of at least, with increasing preference in the order given, 30, 40, 50, 60, 65, 70, 75, 80, or 84° C. and independently preferably, primarily for reasons of economy, is not more than, with increasing preference in the order given, 99, 97, 95, 93, 91, 89, or 87° C.

The practice of this invention may be further appreciated by consideration of the following, non-limiting, working examples, and the benefits of the invention may be further appreciated by reference to the comparison examples.

GROUP 1

Candidate concentrate compositions having the components shown in Table 1.1, with water being the balance of any composition not otherwise specified in Table 1.1, were prepared. As indicated in the Table, some of the candidates did not form stably transparent solutions and are comparison examples, not according to the invention. Those compositions in Table 1.1 that did form stably transparent solutions are examples of concentrates according to the invention.

Working compositions according to the invention were prepared from two of the concentrates according to the invention shown in Table 1.1 and tested for cleaning effectiveness and foaming tendency, at a temperature of 85±2° C., in a pilot scale spray

TABLE 1.1

EXAMPLE AND COMPARISON EXAMPLE CONCENTRATE COMPOSITIONS

| | Percent by Mass of Ingredient in Total Composition Number: | | | | | | | | | |
|---|---|---|---|---|---|---|---|---|---|---|
| Ingredient | 1.1 | 1.2 | 1.3 | 1.4 | 1.5 | 1.6 | 1.7 | 1.8 | 1.9 | 1.10 |
| Sodium Gluconate | 5.8 | 5.7 | 5.7 | 5.7 | 5.7 | 5.7 | 5.7 | 5.7 | 5.7 | 5.7 |
| $CaCl_2$ | 1.9 | 1.9 | 1.9 | 1.9 | 1.9 | 1.9 | 1.9 | 1.9 | 2.9 | 2.9 |
| KRITCHEM ™ 1248-M | 4.7 | 4.6 | 4.6 | 4.6 | 4.6 | 4.6 | 4.6 | 3.0 | 3.0 | 4.6 |
| KOH | 18.2 | 27.0 | 24.3 | 2.7 | 20.7 | 24.3 | 0 | 13.5 | 13.5 | 20.2 |
| NaOH | 0 | 0 | 1.95 | 17.4 | 0 | 0 | 14.8 | 0 | 0 | 0 |
| Composition Transparent: | Yes | No | No | No | Yes | No | No | Yes | Yes | Yes |

cleaning apparatus, either as such or with 0.8 g/L of sodium stearate added to the working compositions to simulate long extended prior use. This pilot scale apparatus includes a holding tank for the working cleaning composition, and foaming tendencies of various compositions can be compared by measuring the height of foam on top of the liquid in the holding tank under constant operating conditions. The substrates were cold rolled steel articles that had been coated with a mixture of sodium and zinc stearates in actual cold drawing operations from a commercial scale operation. After cleaning, the substrates were rinsed for 1.0 minute with water at 57±3° C. and then allowed to spontaneously dry in the normal ambient natural atmosphere. Further process details and results are shown in Table 1.2 below.

All of the compositions shown in Table 1.2 achieved satisfactory cleaning in the times shown there, but foaming was excessive with the "control" comparison working composition and marginally satisfactory with the first shown of the working compositions according to the invention when a high level of sodium stearate, simulating long use, was added. The control concentrate had a chemical constitution very similar to that of Composition 4 from Table 1.1, except that no calcium ions were included in it. The foaming level of the working composition according to the invention made with Concentrate Composition 5 from Table 1.1 could be lowered if desired by regenerating the working composition, as taught above, so as to decrease the level of stearate ions in it.

TABLE 1.2

FOAM HEIGHT AND CLEANING TEST CONDITIONS AND RESULTS

| Characteristics of the Working Composition | | | | |
|---|---|---|---|---|
| Concentrate Composition Number from Table 1 | Volume % of Concentrate in Working Composition | 0.8 g/l of Sodium Stearate Added before Use? | Time of Cleaning Exposure, Minutes | Foam Height, Centimeters |
| 1.5 | 10 | No | 3 | 1.3–2.5 |
| 1.5 | 10 | Yes | 3 | 7.6–10 |
| 1.8 | 15 | No | 4 | 1.3–2.5 |
| 1.8 | 15 | Yes | 4 | 1.3–2.5 |
| Control | 10 | No | 4 | 1.3–2.5 |
| Control | 10 | Yes | 4 | 15–18 |

Concentrates for this group are shown in Table 2.1 below.

TABLE 2.1

EXAMPLE AND COMPARISON EXAMPLE CONCENTRATE COMPOSITIONS

| | Percent by Mass of Ingredient in Total Composition Number: | | | |
|---|---|---|---|---|
| Ingredient | 2.1 | 2.2 | 2.3 | 2.4 |
| Sodium Gluconate | 5.7 | 5.7 | 5.7 | 5.7 |
| $CaCl_2$ | 2.6 | 2.6 | 2.6 | 2.6 |
| TRITON ™ DF-20 | 2.5 | 2.5 | 2.5 | 2.5 |
| TRITON ™ X-100 | 1.0 | 1.0 | 1.0 | 1.0 |
| $NaH_2PO_4$ | 0 | 0.88 | 1.8 | 0.88 |
| KOH | 20 | 20 | 20 | 18 |
| NaOH | 0 | 0 | 0 | 1.4 |
| Composition Number: | 2.1 | 2.2 | 2.3 | 2.4 |
| Composition Transparent: | No | Yes | Yes | No |

Working compositions according to the invention were made by diluting Concentrate Compositions 2.2 and 2.3 from Table 2.1 so as to contain 10% by volume of the Concentrate in the corresponding working composition. These were tested for foaming tendency in the same manner as for Group 1. Results are shown in Table 2.2. The working composition made from Concentrate 2.2 was preferred, because it did not increase in foam height with continued pumping during the time shown. The foam generation with the working composition made from Concentrate 2.3 was acceptable during the time shown, but the tendency to increased foam generation with increasing time might signal eventual problems with such a composition.

TABLE 2.2

FOAMING CHARACTERISTICS OF COMPOSITIONS FROM TABLE 2.1

| Working Composition Made with Concentrate Composition: | Foam Height in Tank, Centimeters | | |
|---|---|---|---|
| | Without Stearate Addition | With Stearate Addition, After: 10 Minutes | 30 Minutes |
| 2.2 | <1 | <1 | <1 |
| 2.3 | <1 | 1 | 2 |

What is claimed is:

1. An aqueous liquid alkaline cleaning composition suitable, directly or being diluted with water, for cleaning soils from a surface of an article, said soils including therein a solid, intermediate length carboxylic acid or salt thereof, the aqueous liquid alkaline cleaning composition comprising:

(A) 3% to 27.5% of dissolved potassium hydroxide; and (B) dissolved magnesium cations, calcium cations, or both magnesium and calcium cations, in a minimal concentration of about 0.030 moles per kilogram of the composition, the intermediate length carboxylate salts of said calcium and/or magnesium cations having a solubility of not greater than 0.15 grams per liter in water at 25 degrees Celsius, wherein the ratio of moles of dissolved magnesium cations, calcium cations, or both magnesium and calcium cations to moles of dissolved potassium cations is from about 0.010:1.00 to about 0.145:1.00, the aqueous liquid alkaline cleaning composition having a molar ratio of sodium cations to potassium cations of not more than 0.17:1.00 when the aqueous liquid alkaline cleaning composition further contains dissolved sodium cations.

2. The liquid composition of claim 1 wherein the dissolved magnesium cations, calcium cations, or both magnesium and calcium cations having a maximal concentration of about 2.0 mol/kg, the composition including dissolved chelating agent molecules in a concentration that corresponds stoichiometrically to a concentration of sodium gluconate that is from about 0.7 to about 25% of the total composition; and the concentration of dissolved chelating agent molecules, measured as its stoichiometric equivalent as sodium gluconate, having a ratio of moles to moles of dissolved hydroxyl ions from about 0.10:1.0 to about 10:1.0.

3. The liquid composition of claim 2 wherein the composition contains about 5.0% to about 27.5% of dissolved potassium hydroxide, the dissolved magnesium cations, calcium cations, or both magnesium and calcium cations having a concentration of about 0.090 to about 1.0 mol/kg, the composition having a ratio of moles of dissolved magnesium cations, calcium cations, or both magnesium and calcium cations to moles of dissolved potassium cations of about 0.030:1.00 to about 0.145:1.00, the concentration of dissolved chelating corresponding stoichiometrically to a concentration of sodium gluconate that is from about 2.0 to about 16% of the total composition, the concentration of dissolved chelating agent, measured as its stoichiometric equivalent as sodium gluconate, having a ratio to the concentration of dissolved hydroxyl ions that is from about 0.30:1.0 to about 6:1.0, the composition containing dissolved surfactant having a concentration of about 0.5 to about 10% of the total composition.

4. The liquid composition of claim 3 wherein the composition contains from about 8.0 to about 27.5% of dissolved potassium hydroxide, the concentration of the dissolved magnesium cations, calcium cations, or both magnesium and calcium cations being about 0.13 to about 0.65 mol/kg, having a ratio of moles of dissolved magnesium cations, calcium cations, or both magnesium and calcium cations to moles of dissolved potassium cations from about 0.050:1.00 to about 0.115:1.00, the concentration of dissolved chelating agent corresponding stoichiometrically to a concentration of sodium gluconate that is from about 4.5 to about 9% of the total composition, the concentration of dissolved chelating agent, measured as its stoichiometric equivalent as sodium gluconate, having a ratio to the concentration of dissolved hydroxyl ions from about 0.50:1.0 to about 2.0:1.0, the concentration of dissolved surfactant having from about 1.5 to about 7.5% of the total composition and including nonionic surfactant as at least about 15% of the total surfactant, with the balance being anionic surfactant, the composition containing anions that includes phosphorus atoms that constitute from about 0.12 to about 0.45% of the total composition.

5. The liquid composition of claim 4 wherein the composition contains about 10.0 to about 25.0% of dissolved potassium hydroxide, the concentration of the dissolved magnesium cations, calcium cations, or both magnesium and calcium cations being about 0.19 to about 0.40 mol/kg, the composition having a ratio of moles of dissolved chelating agent to moles of the dissolved potassium cations in the composition that is from about 0.060:1.00 to about 0.085:1.00, the sodium gluconate having a concentration of about 4.5 to about 7.0% of the total composition, the concentration of sodium gluconate having a ratio to the concentration of dissolved hydroxyl ions from about 0.80:1.0 to about 1.20:1.0, the concentration of dissolved surfactant being from about 2.9 to about 5.5% of the total composition and including nonionic surfactant as at least about 22% of the total surfactant, the composition having a balance of anionic surfactant, the composition having a molar ratio of sodium ions to potassium ions of about 0.055:1.00 to about 0.085:1.00.

6. The liquid composition of claim 1 wherein the composition is made by mixing with water the following materials:

a mass of potassium hydroxide that constitutes from about 3.0% to about 27.5% of the total composition;

a mass of the dissolved magnesium cations, calcium cations, or both magnesium and calcium cations that constitutes a maximal concentration of about 2.0 mol/kg, the mass of the dissolved magnesium cations, calcium cations, or both magnesium and calcium cations constituting a number of moles of the dissolved magnesium cations, calcium cations, or both magnesium and calcium cations that has a ratio to the number of moles of potassium ions in the composition that is from about 0.010:1.00 to about 0.145:1.00; and a mass of the dissolved chelating agents of dissolved chelating agent molecules that corresponds stoichiometrically to a mass of sodium gluconate that constitutes from about 0.7 to about 25% of the total composition and has a ratio to the mass of dissolved hydroxyl ions in the composition that is from about 0.10:1.00 to about 10:1.00.

7. A liquid composition according to claim 6, the composition having been made by mixing with water the following materials:

a mass of potassium hydroxide that constitutes from about 5.0 to about 27.5% of the total composition;

a mass of the dissolved magnesium cations, calcium cations, or both magnesium and calcium cations that constitutes from about 0.090 to about 1.0 mol/kg, the mass of the dissolved magnesium cations, calcium cations, or both magnesium and calcium cations constituting a number of moles of the dissolved magnesium cations, calcium cations, or both magnesium and calcium cations that has a ratio to the number of moles of potassium ions in the composition that is from about 0.030:1.00 to about 0.145:1.00;

a mass of the dissolved chelating agents of dissolved chelating agent molecules that corresponds stoichiometrically to a mass of sodium gulconate that constitutes from about 2.0 to about 16% of the total composition and has a ratio to the mass of dissolved hydroxyl ions in the composition that is from about 0.30:1.0 to about 6:1.0; and a mass of the dissolved surfactant of water soluble surfactant that constitutes from about 0.5 to about 10% of the total composition.

8. The liquid composition of claim 7, the composition having been made by mixing with water the following materials:

a mass of potassium hydroxide that constitutes from about 8.0 to about 27.5% of the total composition;

a mass of the dissolved magnesium cations, calcium cations, or both magnesium and calcium cations that constitutes from about 0.13 to about 0.65 mol/kg, the mass of constituting a number of moles of dissolved magnesium cations, calcium cations, or both magnesium and calcium cations that has a ratio to the number of moles of potassium ions in the composition that is from about 0.050:1.00 to about 0.115:1.00;

a mass of the dissolved chelating agents of dissolved chelating agent molecules that corresponds stoichiometrically to a mass of sodium gluconate that constitutes from about 4.5 to about 9% of the total composition and has a ratio to the mass of dissolved hydroxyl ions in the composition that is from about 0.50:1.0 to about 2.0:1.0;

a mass of the dissolved surfactant that constitutes from about 1.5 to about 7.5% of the total composition and that includes nonionic surfactant as at least about 15% of the total surfactant, with the balance being anionic surfactant, if the composition does not include anions that include phosphorus atoms that constitute from about 0.12 to about 0.45% of the total composition; and a mass of a source of water soluble anions, the mass being exclusive of materials that constitute components in the composition that include phosphorus atoms in an amount such that the phosphorus atom content in anions in all substances mixed to make the total composition is from about 0.12 to about 0.45% of the total composition.

9. The liquid composition of claim 8, the composition having been made by mixing with water the following materials:

a mass of potassium hydroxide that constitutes from about 10.0% to about 25% of the total composition;

a mass of the dissolved magnesium cations, calcium cations, or both magnesium and calcium cations that constitutes from about 0.19 to about 0.40 mol/kg, the mass of the dissolved magnesium cations, calcium cations, or both magnesium and calcium cations constituting a number of moles of the dissolved magnesium cations calcium cations, or both magnesium and calcium cations that has a ratio to the number of moles of potassium ions in the composition that is from about 0.060:1.00 to about 0.085:1.00;

a mass of sodium gluconate that constitutes from about 4.5 to about 7.0% of the total composition and that has a ratio to the mass of dissolved hydroxyl ions in the composition that is from about 0.80:1.0 to about 1.20:1.0; and a mass of the water soluble surfactant that constitutes from about 2.9 to about 5.5% of the total composition and that includes nonionic surfactant as at least about 22% of the total surfactant, with the balance being anionic surfactant, the composition having a molar ratio of sodium ions to potassium ions that is from about 0.055:1.00 to about 0.085:1.00.

10. The liquid composition of claim 11 wherein the dissolved magnesium cations, calcium cations, or both magnesium and calcium cations are derived from magnesium chloride, magnesium nitrate, calcium chloride, calcium nitrate, and mixtures thereof.

* * * * *

UNITED STATES PATENT AND TRADEMARK OFFICE

CERTIFICATE OF CORRECTION

PATENT NO. : 6,440,917 B1
DATED : August 27, 2002
INVENTOR(S) : Church et al.

It is certified that error appears in the above-identified patent and that said Letters Patent is hereby corrected as shown below:

Title page,
Item [57], ABSTRACT,
Line 5, delete "clearners", and insert therefor -- cleaners --.

Column 17,
Line 12, after the first instance of "cations" and before "calcium", insert -- , --.

Column 18,
Line 11, delete "claim 11", and insert therefor -- claim 1 --.

Signed and Sealed this

Twenty-first Day of June, 2005

JON W. DUDAS
*Director of the United States Patent and Trademark Office*